US008905779B2

(12) United States Patent
Little et al.

(10) Patent No.: US 8,905,779 B2
(45) Date of Patent: Dec. 9, 2014

(54) ELECTRICAL CONNECTOR HAVING A PLURALITY OF DETECTING PINS

(71) Applicant: Hon Hai Precision Industry Co., Ltd., New Taipei (TW)

(72) Inventors: Terrance F. Little, Fullerton, CA (US); An-Jen Yang, Irvine, CA (US); Chien-Ping Kao, Hershey, PA (US); Chun-Ming Yu, Kunshan (CN); Kuo-Chun Hsu, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 99 days.

(21) Appl. No.: 13/846,940

(22) Filed: Mar. 18, 2013

(65) Prior Publication Data

US 2014/0273653 A1 Sep. 18, 2014

(51) Int. Cl.
*H01R 3/00* (2006.01)
*H01R 13/641* (2006.01)

(52) U.S. Cl.
CPC ..... *H01R 13/641* (2013.01)
USPC ..... 439/489

(58) Field of Classification Search
USPC ..... 439/489, 188, 630, 660
See application file for complete search history.

(56) References Cited

U.S. PATENT DOCUMENTS

| | | | | |
|---|---|---|---|---|
| 7,207,819 | B2 * | 4/2007 | Chen | 439/188 |
| 7,367,844 | B2 * | 5/2008 | Xu | 439/630 |
| 7,413,467 | B1 * | 8/2008 | Lai et al. | 439/489 |
| 7,588,470 | B2 | 9/2009 | Li et al. | |
| 8,690,608 | B2 | 4/2014 | Naito | |
| 8,747,147 | B2 * | 6/2014 | Yu et al. | 439/489 |
| 2013/0316592 | A1 * | 11/2013 | YU et al. | 439/660 |
| 2014/0051274 | A1 * | 2/2014 | YU et al. | 439/188 |
| 2014/0051302 | A1 * | 2/2014 | YU et al. | 439/660 |

FOREIGN PATENT DOCUMENTS

| | | |
|---|---|---|
| CN | 202308544 U | 7/2012 |
| TW | M378500 | 4/2010 |

* cited by examiner

*Primary Examiner* — Chandrika Prasad
(74) *Attorney, Agent, or Firm* — Wei Te Chung; Ming Chieh Chang

(57) ABSTRACT

An electrical connector includes an insulative housing formed with a rear base and a front mating tongue, a metallic shell covering the insulative housing thereby defining a mating cavity, contacts, and a first and a second detecting pin. The mating tongue defines a first and a second face and two lateral sides between the first and second faces. The contacts include contacting portions located on the first face. Each of the first and the second detecting pins forwardly protrude and has a contacting portion located in the mating cavity. The contacting portion of the first detecting pin is located behind that of the second detecting pin in the insertion direction. The contacting portion of the first detecting pin is located along and space from one of the lateral sides, the contacting portion of the second detecting pin is located in the second face of the mating tongue.

14 Claims, 15 Drawing Sheets

ELECTRICAL CONNECTOR HAVING A PLURALITY OF DETECTING PINS

BACKGROUND OF THE INVENTION

1. Field of the Invention

The present invention relates to an electrical connector, and more particular to an electrical connector with bi-detecting pins for indicating insertion of different mating plugs therein. The invention is related to the co-pending application Ser. No. 13/659,936 filed Dec. 25, 2012.

2. Description of the Related Art

USB Implementers Forum, Inc, has developed Universal Serial Bus 3.0 Specification on Nov. 12, 2011, we call it as USB 3.0 specification, and a USB (Universal Serial Bus) 3.0 receptacle and a USB 3.0 plug are introduced therein. USB 3.0 has a higher transfer rate of 4.8 Gbit/s, while a transfer rate of previous USB 2.0 connectors is just 480 Mbit/s. However, someone think a new USB connector capability of delivering a big power is needed too, so USB Implementers Forum, Inc, published USB Power Deliver specification on Jul. 5, 2012, which discloses USB 3.0 PD (Power Deliver) plug and USB 3.0 PD (Power Deliver) receptacle on pages 46-50 of the specification.

The USB PD 3.0 receptacle adds a pair of insertion detecting pins, PIN No. 12-13, and two PD detect pins, PIN No. 10-11 relative to USB 3.0 receptacle. The insertion detect pins, PIN No. 12-13 are closed to an insertion port of a receiving space of the USB PD 3.0 receptacle, and pin 13 is located under the pin 12, when a USB plug, including USB 2.0 plug, USB 3.0 plug, USB PD 3.0 plug, and thin card, inserts into the USB PD 3.0 receptacle, the pin 12 is downwardly pressed by the USB plug and contacts with the pin 13, so an insertion detect circuit is turned on. The PD detect pins, PIN No. 10-11, are disposed near the end of the receiving space, away from the insertion port.

USB PD 3.0 plug is specially designed, a shell thereof is extending beyond a free edge of a tongue of the insulative housing, so a length of a front part of the USB PD 3.0 plug in front of a blocking wall is about 10.05 mm, the front part can be completely received in USB PD 3.0 receptacle and USB 3.0 receptacle. While the length of a corresponding front part of USB 2.0 plug and USB 3.0 plug is 8.65 mm.

For the USB PD 3.0 receptacle, when USB 2.0 plug or USB 3.0 plug is inserted, since the corresponding front part is not long enough, the PD detect pin will not be touched; when USB 3.0 PD plug is inserted, since the front part of USB 3.0 PD plug can arrive the end of the receiving space of the USB PD 3.0 receptacle, the PD detect pin will touch the shell of the USB 3.0 PD plug and turn on the PD detect circuit; the final situation is the thin card inserted, however, a corresponding front part of the thin card is an plastic part, can not turn on the circuit. So, only USB 3.0 PD plug can conduct the PD detect pins of USB 3.0 PD receptacle, and then a big power transmission will be put between USB 3.0 PD plug and USB 3.0 PD receptacle.

However, the arrangement of the insertion detect pins and the PD detect pin are complex, an improved connector is needed.

SUMMARY OF THE INVENTION

Accordingly, an object of the present invention is to provide an electrical connector having detecting pins.

In order to achieve the object set forth, an electrical connector comprises an insulative housing formed with a rear base and a front mating tongue, a metallic shell covering the insulative housing thereby defining a mating cavity surrounding the front mating tongue for receiving a mating plug and defining an insertion direction, a plurality of contacts loaded on the insulative housing, and a first detecting pin and a second detecting pin fastened to the rear base. The mating tongue defines a first face, a second face opposite to the first face and two lateral sides between the first and second faces. The contacts comprise contacting portions located on the first face of the mating tongue. Each of the first and the second detecting pins forwardly protrudes and has a contacting portion located in the mating cavity, Said the contacting portion of the first detecting pin is located behind the contacting portion of the second detecting pin in the insertion direction. The contacting portion of the first detecting pin is located along and spaces from one of the lateral sides of the mating tongue, the contacting portion of the second detecting pin is located in the second face of the mating tongue.

Other objects, advantages and novel features of the invention will become more apparent from the following detailed description of the present embodiment when taken in conjunction with the accompanying drawings.

DETAILED DESCRIPTION OF THE INVENTION

Figure 1:
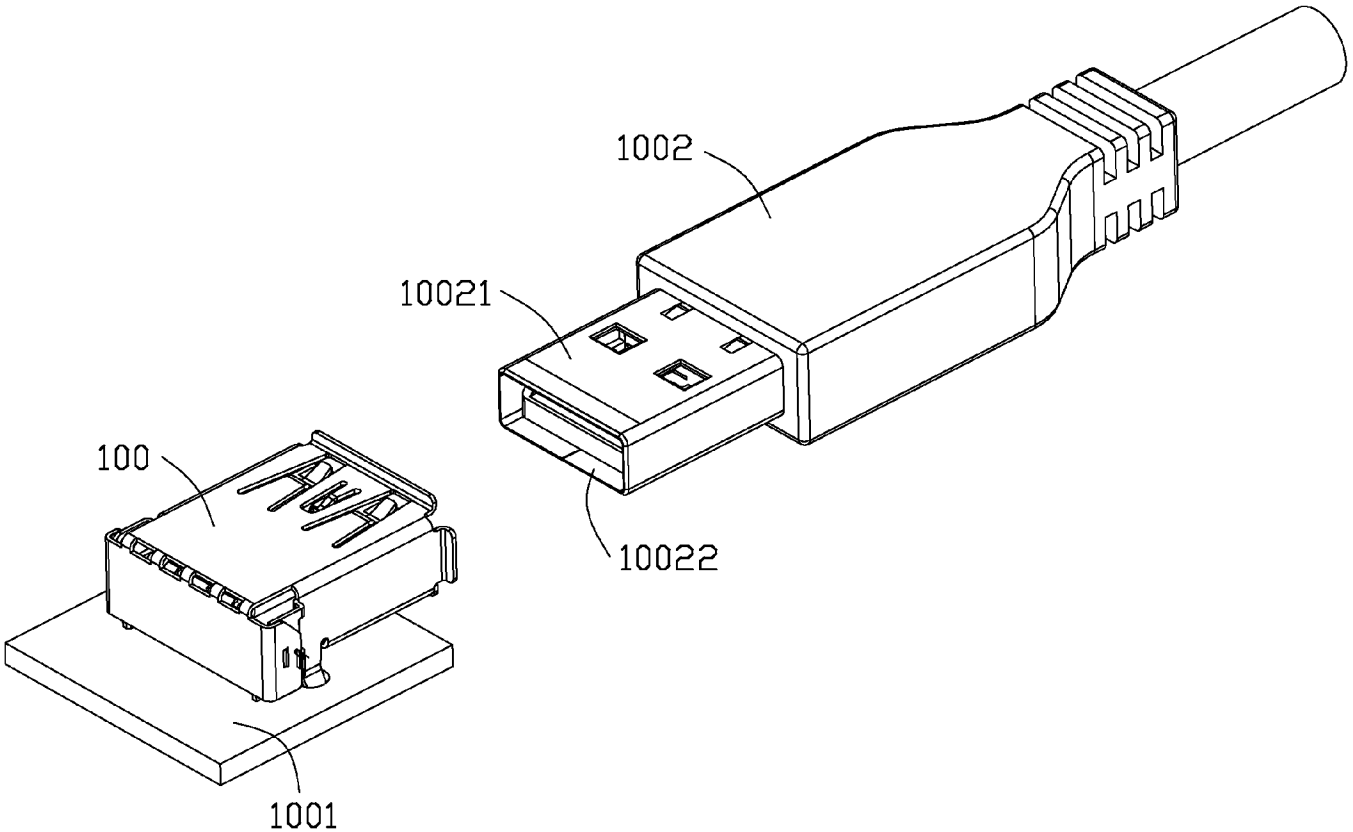
FIG. 1 is an assembled, perspective view of an electrical connector of a first embodiment in accordance with the present invention, which disconnects from a USB 3.0 PD plug connector.

Reference will be made to the drawing figures to describe the present invention in detail, wherein depicted elements are not necessarily shown to scale and wherein like or similar elements are designated by same or similar reference numeral through the several views and same or similar terminology.

FIG. 1 to FIG. 8 show an electrical connector 100 or receptacle connector in accordance with a first embodiment of the present invention, which is provided and configured as a USB 3.0 PD receptacle, it should be pointed out that the other similar electrical connectors, such as USB 2.0 connector, eSATA connector, DisplayPort connector and et al, are also suitable for incorporation of the present invention. The electrical connector 100 has a substantial same configuration as that of USB 3.0 receptacle except further having detecting pins. A legacy USB 3.0 receptacle are described in detail in many patents, such as U.S. Pat. No. 7,625,243, the disclosure of which are incorporated herein by reference to the extent not inconsistent herewith. The electrical connector 100 is configured to be mounted on a printed circuit board 1001 and mate with a USB 3.0 PD plug connector 1002. The USB 3.0 PD plug cable connector 1002 has an inserting port 10021 longer than corresponding port of a legacy USB 3.0 plug connector, the longer portion is labeled as a front extending portion 10022, which has an AU plating inside thereof, thereby increasing conduction capability.

Figure 2:
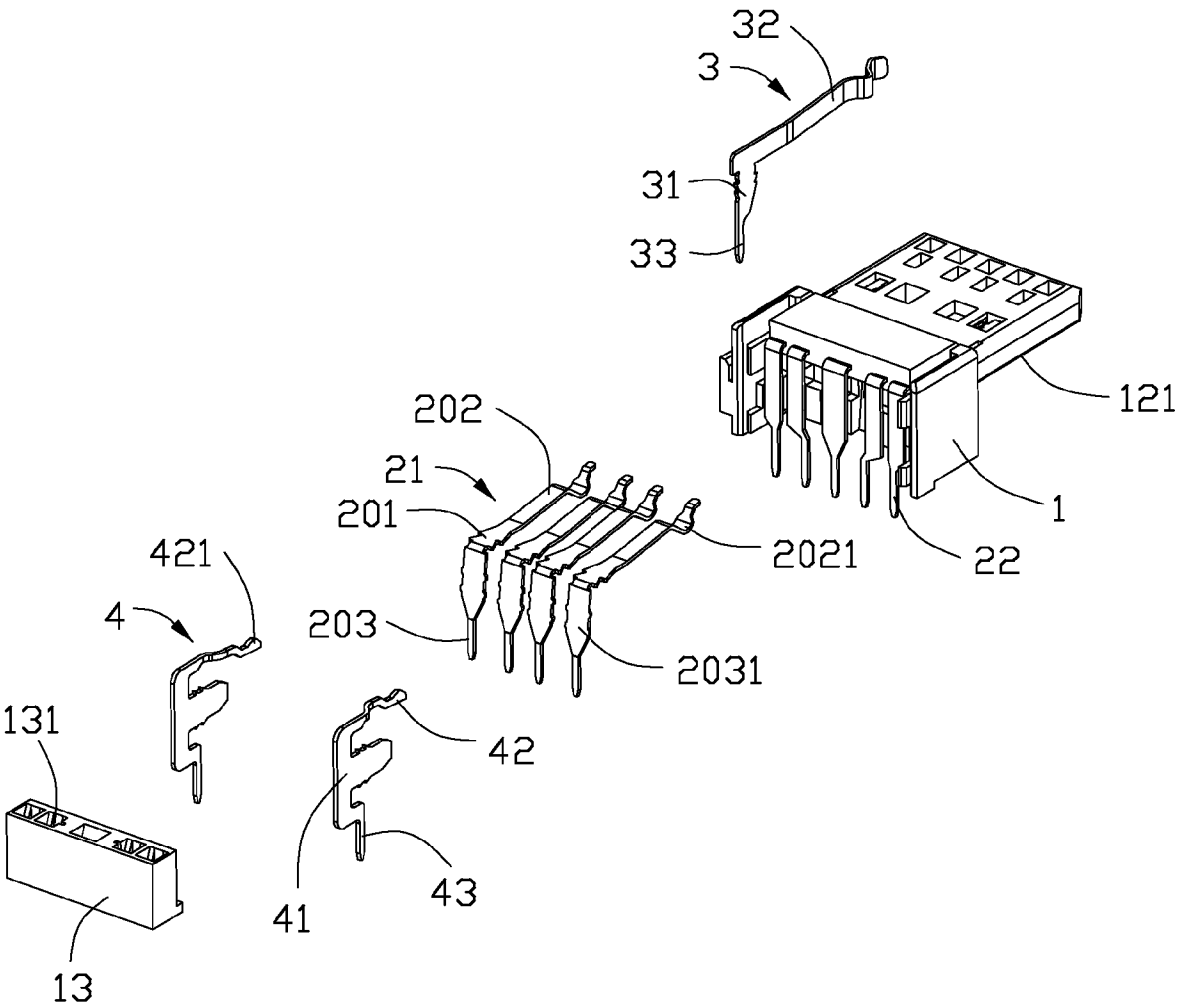
FIG. 2 is an exploded perspective view of the electrical connector shown in FIG. 1, wherein a metal shield is removed from a housing.
Figure 3:
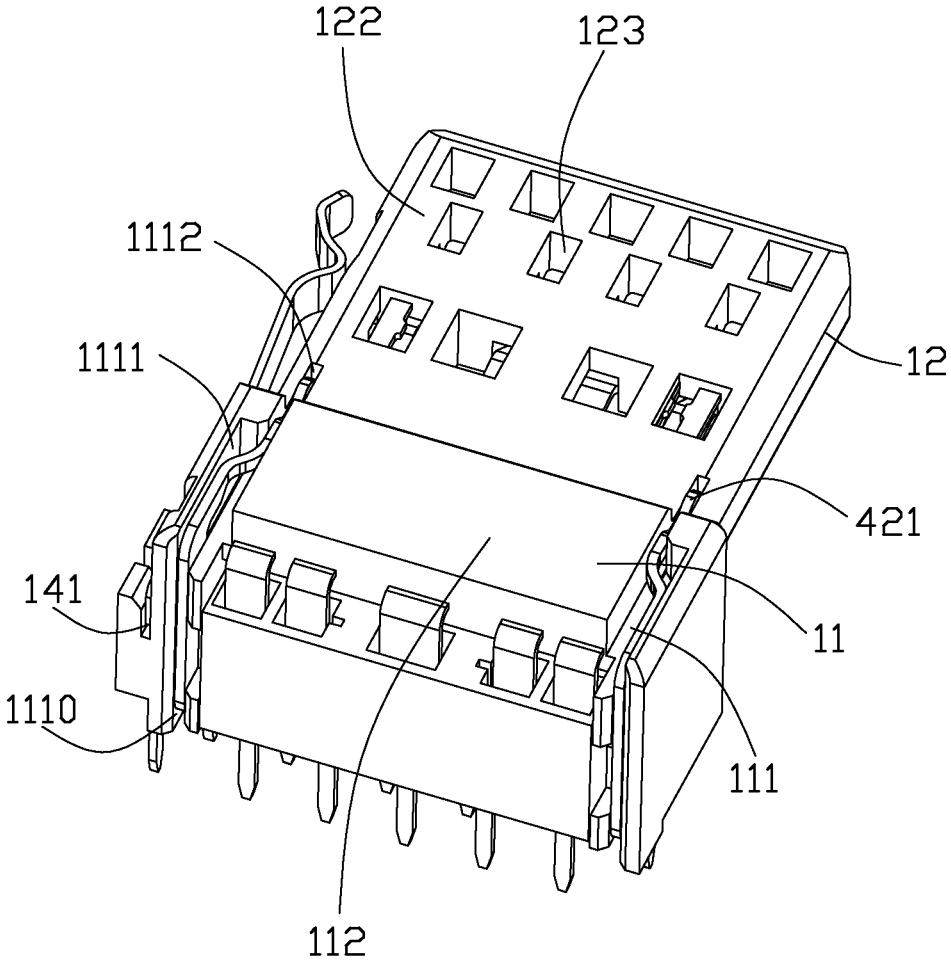
FIG. 3 is a perspective view of the electrical connector shown in FIG. 3.
Figure 5:
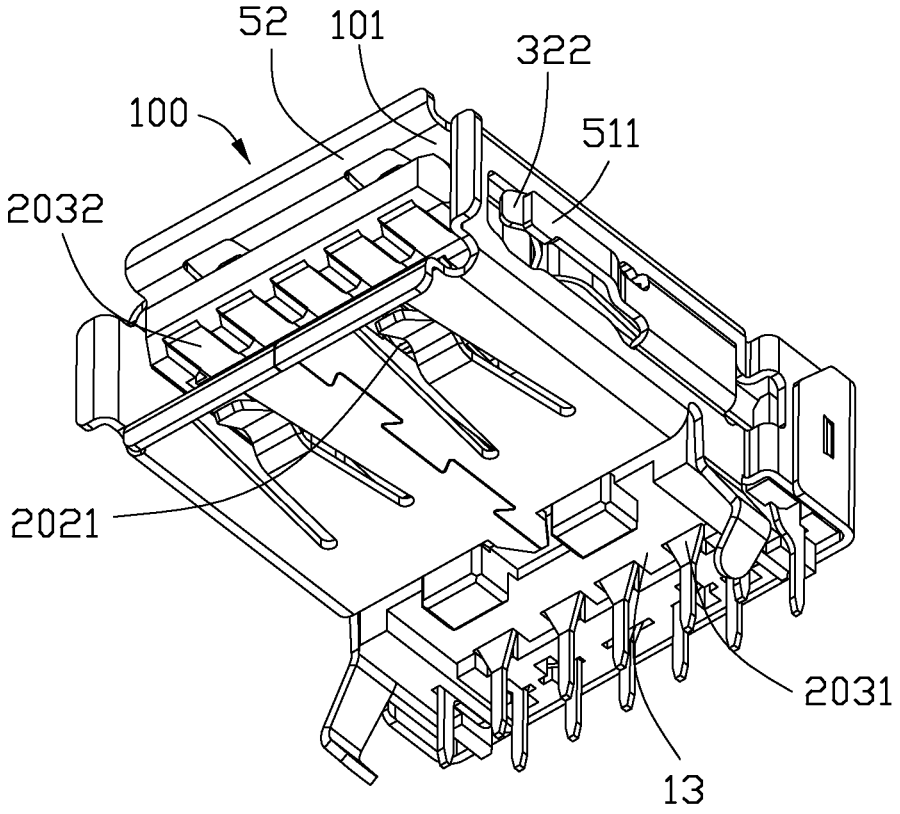
FIG. 5 is another perspective view of the electrical connector shown in FIG. 1.

Referring to FIGS. 2 and 3, the electrical connector 100 comprising an insulative housing 1, first terminals 21 and second terminals 22 retained in the insulating housing for signal transmission, a first detecting pin 3 and a pair of second detecting pins 4 retained on housing. The housing 1 defines a rear base 11 and a front mating tongue 12 extending from the base. The first terminals 21 are arranged in a row and inserted into the mating tongue 12 with arced elastic contacting portions 2021 exposing to a lower face 121 or a first face of mating tongue 12. The second terminals 22 are arranged in a row and inserting-molded in the housing tongue 12 with planar contacting portions 2022 exposing to the lower face 121 of the mating tongue in front of contacting portion 2021 of the first terminals 21 as best shown in FIG. 5. The four first terminals 3 and five second terminals 4 are jointly compliance to USB 3.0 standard in this embodiment. Each of the first and second terminals comprises a retained portion 201 retained in the base, a contacting arms 202 extending along the mating tongue 12 and a leg portion 203 bending downward along the base 11 to be soldered to the board 1001. Upper portions 2031 of the leg portions 203 of the first terminals 21 are enlarged with bars, combination with FIG. 5, the upper portions 2031 of first terminals are assembled in through holes 131 of a spacer 13 when the space 13 is assembled from a bottom of the base 12.

The first detecting pin 3 include a retained portion 31 and contacting arm 32 extending forwards and a leg portion 33 extending downwards. The retained portion 31 with bars of the first detecting pin 3 is upright because of down insertion of the first detecting pin 3. Alternatively, the retained portion 31 with bars is horizontal if the first detecting pin is forwardly inserted. The second detecting pin 4 includes an inverted T-shaped retained portion 41, a contacting arm 42 extending forwards and a leg portion 43 extending downwards. Combination with FIGS. 3 and 4, the base 11 defines a pair of second slots 111 extending from the rear of the base to a rear end of the mating tongue 12. The second detecting pins 4 are inserted to the mating tongue 12 from a rear of the base 11. The second slot 111 has a T-shaped or first portion 1110 in the rear of the base, a wider or second portion 1111 and a smaller or third portion 1112 located at a top face 112 of the base and a top face 122 or a second face of the mating tongue 12. The second portion 1111 is wider than the third portion in a lateral direction of the base. The second portion and the third portion have a same inner side, thereby guiding insertion of the contacting arms 42 of the second detecting pins 4. The inverted shape retained portion 41 is received and retained in the first portion 1110 of the second slot 111, and the contacting arm 42 is received to the third portion 1112 through the second portion 1111 of the second slot 111. The contacting arms 42 of the second detecting pins are floatablely received in the second and third portions of the second slots 11 in a vertical direction perpendicular to the lateral direction and an insertion direction. The top face 122 of the mating tongue 12 is configured with a plurality of opening 123 when inserted molded. The base 11 further defines a supporting flange 14 at a lateral side thereof, which defines a T-shaped first slot 141. The first slot runs through a front and a bottom of the supporting flange 14. The first detecting pin 3 is inserted into the first slot 141 from an upper face of the base 11, wherein the upper portions 2031 is retained in the upright portion of the first slot 141 and the rear portion of the contacting arm 32 is retained in the horizontal portion of the slot 141. The free end of the contacting arm 32 of the first detecting pin 3 defines an inward-arced contacting portion 321 projecting toward the lateral side 124 of the mating tongue 12. The lateral side 124 of the mating tongue defines a recess 125 facing the contacting portion 321.

Figure 4:
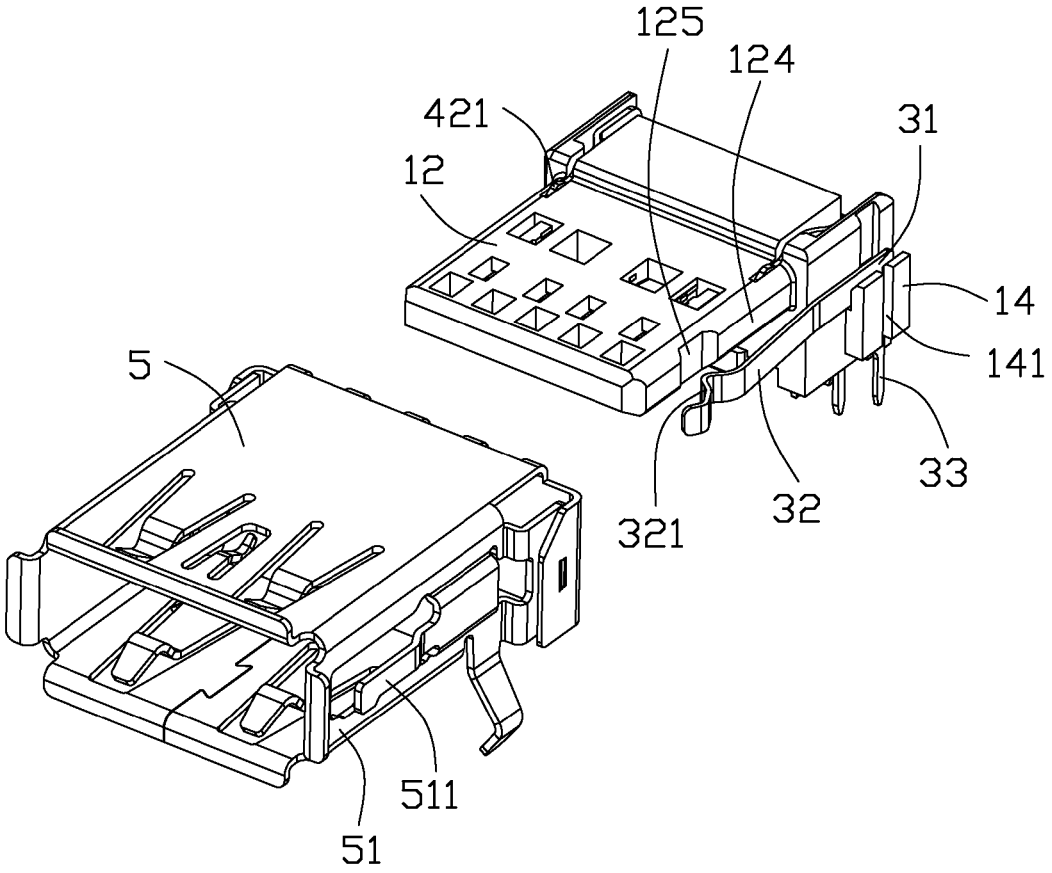
FIG. 4 is another exploded, perspective view of the electrical connector shown in FIG. 1.

Referring to FIGS. 4 and 5, a metal shield 5 of frame shape is retained on the base and surrounding the mating tongue, thereby forming a mating cavity 101 into which the mating tongue extends in the inserting direction. A touching arm 511 is punched from a sidewall 51 of the metal shield 5, the touching arm 511 extends forwards and parallel to the sidewall 51. The touching arm 511 is disposed at outside of the sidewall 51. After the metal shield 5 is assembled on the insulating housing 1, the contacting arm 32 of the first detecting pin 3 extends in the mating cavity 101 and a distal free end of the contacting arms 32 named as a touching end 322 faces the touching arm 511. The contacting arm 32 will shift outwards when the contacting portion 321 is actuated by a plug connector, and then the touching end 322 mechanically contacts the touching arm 511 of the shield 5, completing a switch function. The contacting arms 42 of the second detecting pins extend in the mating cavity 101, the contacting arms 42 are located at the top face 122 of the mating tongue 12 and a top wall 52 of the shield. The contacting portions 421 of the second detecting pins extend from the top face 122 of the mating tongue 12 and near to a front face of the base and can be driven downward by a plug connector.

Figure 6:
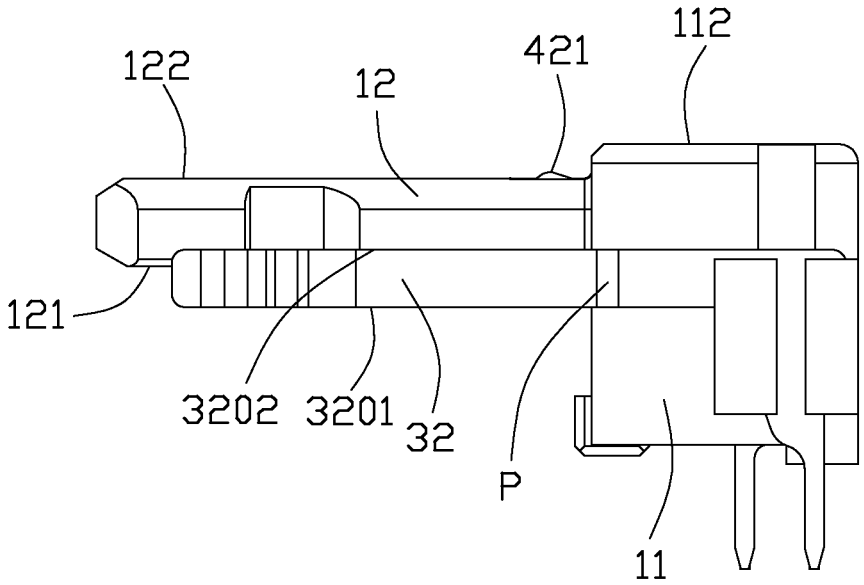
FIG. 6 is a side elevation view of the connector shown in FIG. 3.
Figure 7:
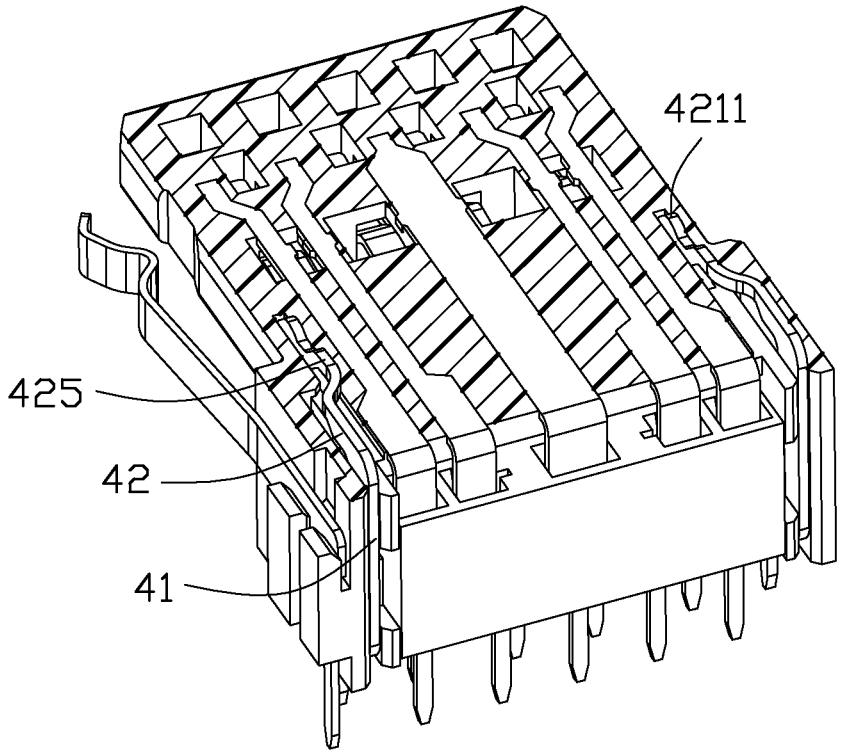
FIG. 7 is a perspective view similar to FIG. 3, wherein a top portion above the second signal terminals is cut away.
Figure 8:
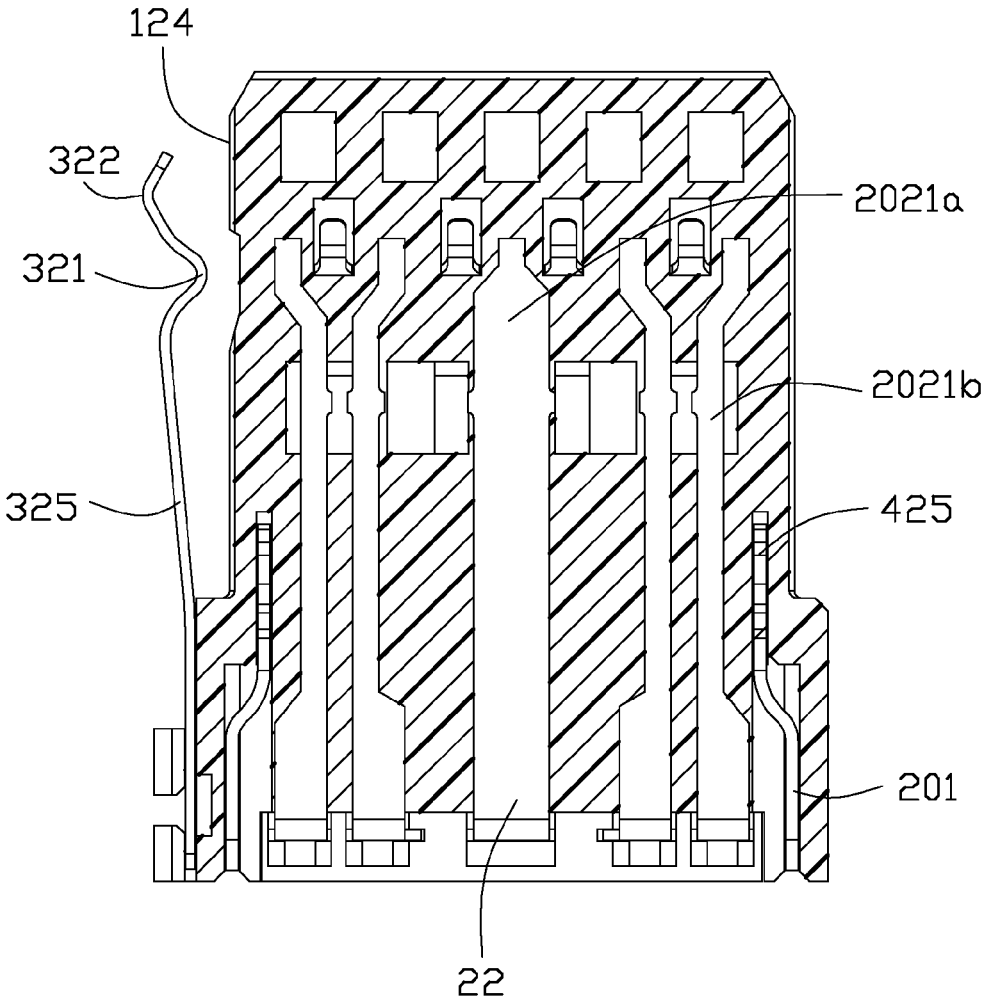
FIG. 8 is a top elevation view of the connector shown in FIG. 7.

As shown in FIGS. 6-8, the contacting arms 32 of the first detecting pin has a lower edge 3201 below the lower face 121 of the mating tongue and the top edge 3202 of the first detecting pin is disposed between the lower face 121 and the top face 122 of the mating tongue. The contacting arms 32 of the first detecting pin outwardly slant at a position P near a front face of the base 11 but behind the front face, thereby forming an inclined outward arm 325 with a small angle, far away from the lateral side 124 of the mating tongue. The contacting portion 421 is higher than the top face 122 of the mating portion and under the top face 112 of the base 11. The contacting arms 42 of the second detecting pins bend laterally inwards compared from the retained portion 41, so that the contacting arms 42 are disposed in the mating tongue and the base. The second detecting pins 4 are made from a blank metal sheet, a front portion (named as an inward-inclined arm 425) of the contacting arms 42 bending inwards in a thickness direction of the metal sheet, the form method benefit an easy produce of the second detecting pins. The contacting portion 421 is in a substantial triangle shape and a tip of the triangle shape forms a contacting point 4211. The contacting point 4211 is defined at a cutting edge of the metal blank sheet along the thickness direction of the metal blank sheet. A bottom side of the triangle shape is parallel to the top face 122 of the mating tongue 12. It's understandable that the contacting portions 421 are formed by cutting, which is easily produced compared a bending arc portion of a conventional detecting pin, especially in a pin with tiny dimension. As described in related art, a smaller space is predetermined near to the front face of the base, for disposition of the second detecting pins. The second detecting pins can be tiny. Moreover, the contacting arms 42 extend from the rear base 11 to the mating tongue 12, which are prolonged and provide enough elasticity to touch with the plug connector reliably. The two second detecting pins 4 are located at two lateral sides of the base, which will balance insertion force of the plug connector.

The second terminals 22 have middle portions 2021*a*, 2021*b* connecting with the contacting portions and the retained portion thereof. The middle one (i.e., grounding terminals) of the second terminals has a wider middle portion 2021*a* and the two outside pairs (i.e., differential pair) of the second terminals have smaller middle portions 2021*b* and each pair of the middle portions shift inwards oppositely so that width dimension between the two pair of the second terminals become smaller. That is, the distance between two pairs of the second terminals 22 become larger, which will decrease cross-talk between pairs of the second terminals 22. The enlarged width of the grounding terminal also will decrease cross-talk between pairs of the second terminals. The inclined inward arms 425 of the contacting arms 42 bend to the inward bending portion of the pair of the second terminals. Said two pairs of the second terminals are symmetrical and two terminals of each pair are symmetrical, such arrangement also benefit decrease of cross-talk.

When the USB PD plug connector 1002 as shown in FIG. 1 is inserted into the mating cavity 101, the outside of the inserting port 10021 press against the contacting portion 321 of the first detecting pin 3 to shift outwards, resulting that the touching end 322 mechanically and electrically connecting with the touching arm 511 of the metal shell 5 to complete a detecting function of an insertion of the USB PD plug connector 1002. When the inserting port 10021 continue inwards, the inside of the extending portion 10022 of the inserting port 10021 press against the contacting portions 421 of the second detecting pins 4 and the extending portion 10022 mechanically and electrically connect with the second detecting pins 4, to complete a detecting function of the type of the USB PD plug connector.

Figure 9:
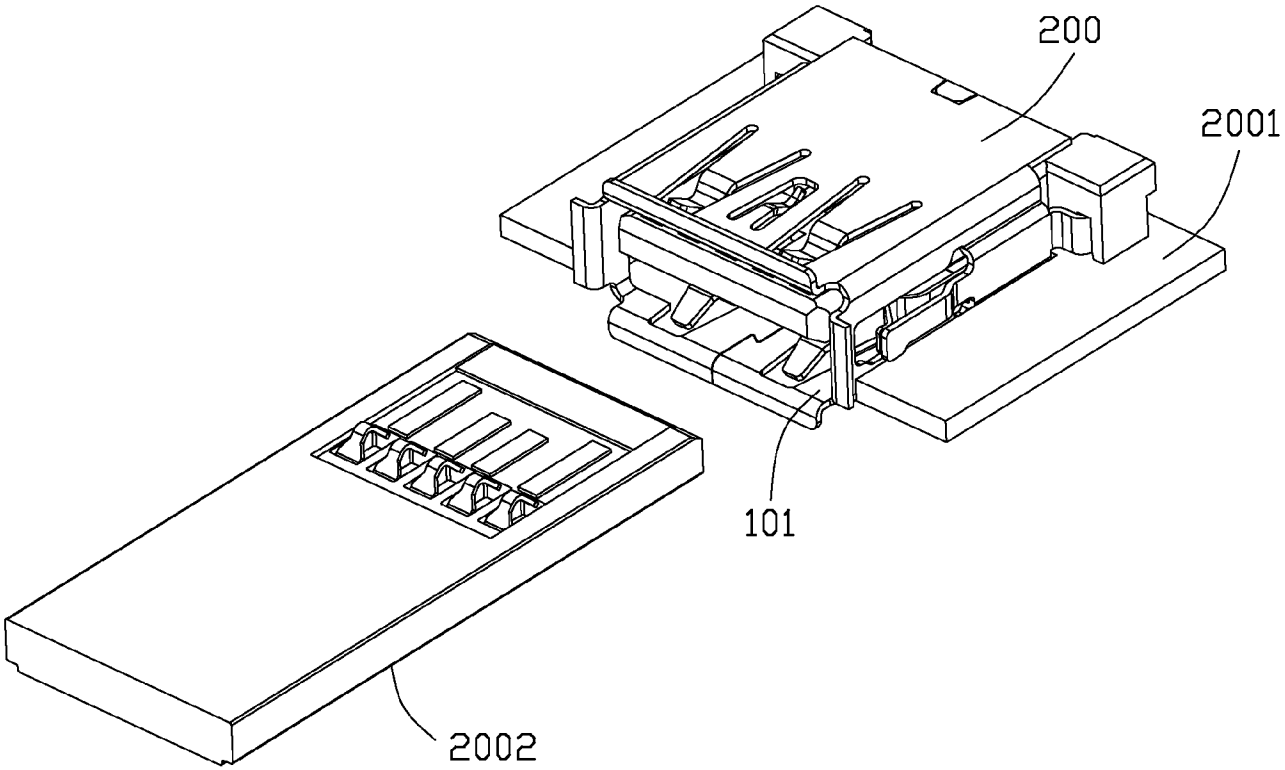
FIG. 9 is an assembled, perspective view of an electrical connector of a second embodiment in accordance with the present invention, which disconnects from a Thin card.
Figure 10:
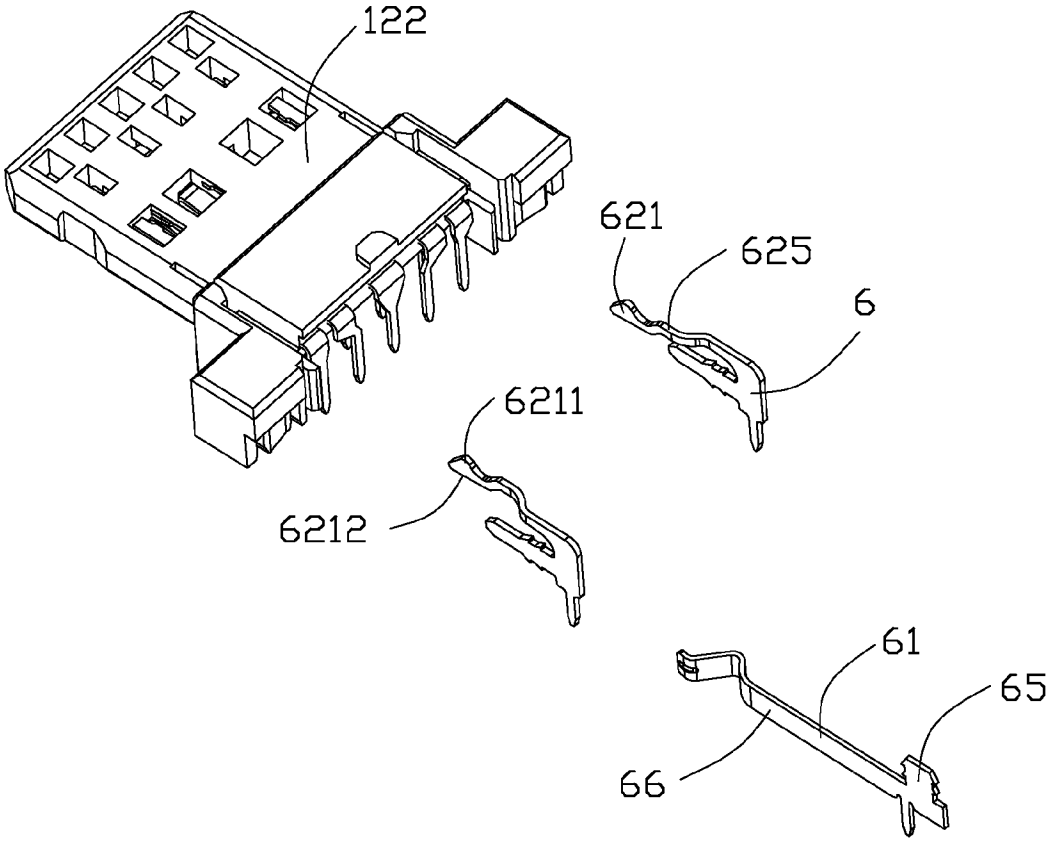
FIG. 10 is an exploded perspective view of the electrical connector shown in FIG. 9, wherein a metal shield is removed from a housing.
Figure 11:
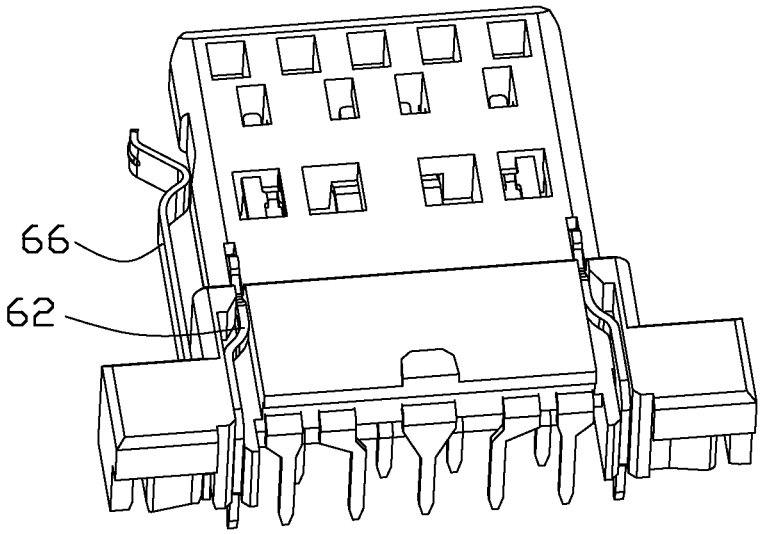
FIG. 11 is a perspective view of the electrical connector shown in FIG. 10.
Figure 12:
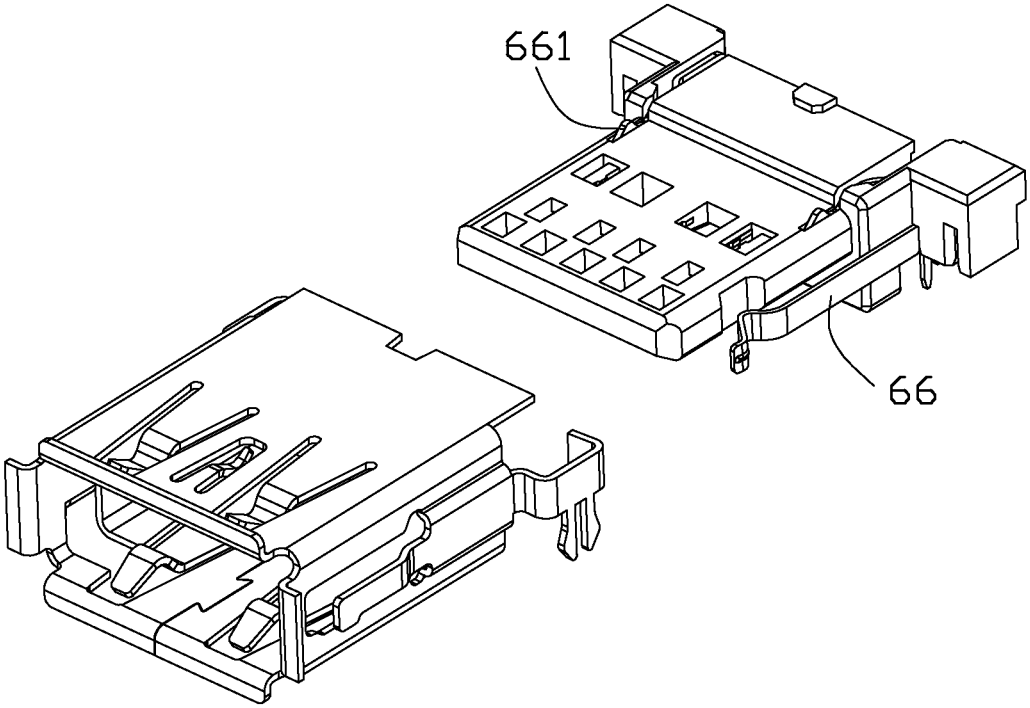
FIG. 12 is an exploded, perspective view of the electrical connector shown in FIG. 9.
Figure 13:
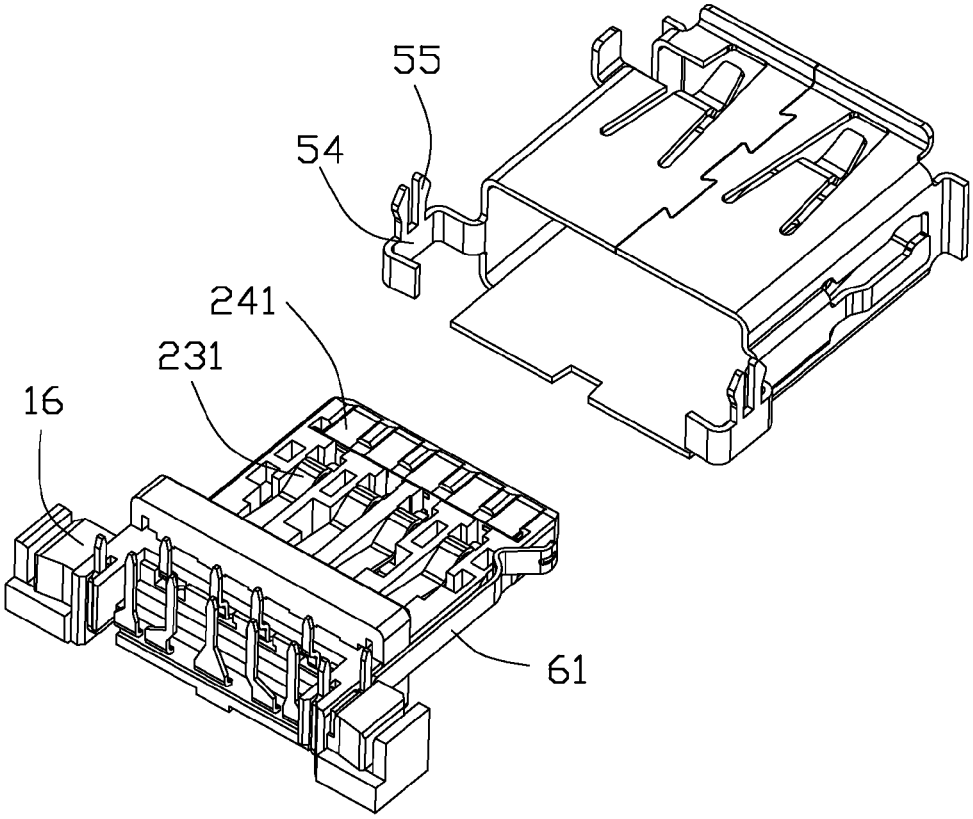
FIG. 13 is another exploded, perspective view of the electrical connector shown in FIG. 9.

When a conventional USB plug connector (not shown) is inserted in the mating cavity 101, the outside of the plug connector drives the first detecting pin 3 to touch the shell. The front edge of the inserting port do not arrive the second detecting pins 4, the second detecting pins keep on an original statue. The electrical connector 100 also can be inserted with a Thin card which is shown in FIG. 9 in a second embodiment, which will be described hereinafter.

The electrical connector 100 has a simple configuration and can provide two-step detecting, not only detecting if a plug is inserted but also detecting if a certain plug is inserted. The mating cavity 101 needs not to provide additional space for the detecting pins and still keeps a standard inserting port.

FIGS. 9 through 13 show an electrical connector 200 of a sink type USB 3.0 receptacle of a second embodiment of this present invention. The electrical connector 200 is seated in a notch of and on a top face of a printed circuit board 2001, so that a bottom face of the electrical connector is below a top face. The electrical connector 200 is similar to that of the first embodiment. For understanding easily, the embodiment show a thin card 2002 which is intended to be inserted in the mating cavity 101 of the electrical connector 200. The connector 200 has a first detecting pin 61 and a pair of second detecting pins 6. The first detect pin 61 is used as an insertion detecting pin, and the second detecting pin 6 is used as a PD detect pin, so the contacting arm 66 directly extending from the retained portion 65 of the first detect pin 61 is longer than the contacting arms 62 of the second detect pins 6 which are closed to a rear end of the mating cavity 101. By such arrangement, any USB Plug, including thin card, can touch the first detecting pin 61 and push the first detect pin 5 outwardly, then a status of corresponding detect circuit (not shown, may be designed in the printed circuit board) shifts from "close" to "open", to indicate an USB Plug is inserted, a power supply may begin.

The inclined-inwards contacting portion 625 of the contacting arms 62 shift inward and the contacting portion 621 is in a triangle shape and a tip of the triangle shape forms a contacting point 6211. The contacting point is defined at a cutting edge of the metal blank sheet along a thickness direction of the metal blank sheet. A bottom side 6212 of the triangle shape is parallel to the top face 122 of the mating tongue. The T-shaped retained portion 61 has a shorter upright portion since the base portion is shorter. The planar contacting portions 241 of the second terminals are located in front of the arc contacting portions 231 of the first terminals. A pair of connecting legs 54 extends from rear edges of the sidewalls of the metal shield and attached on two flanges 16 integrally defined on lateral sides of the base. A pair of solder legs 55 extends downwards of the connecting legs.

Figure 14:
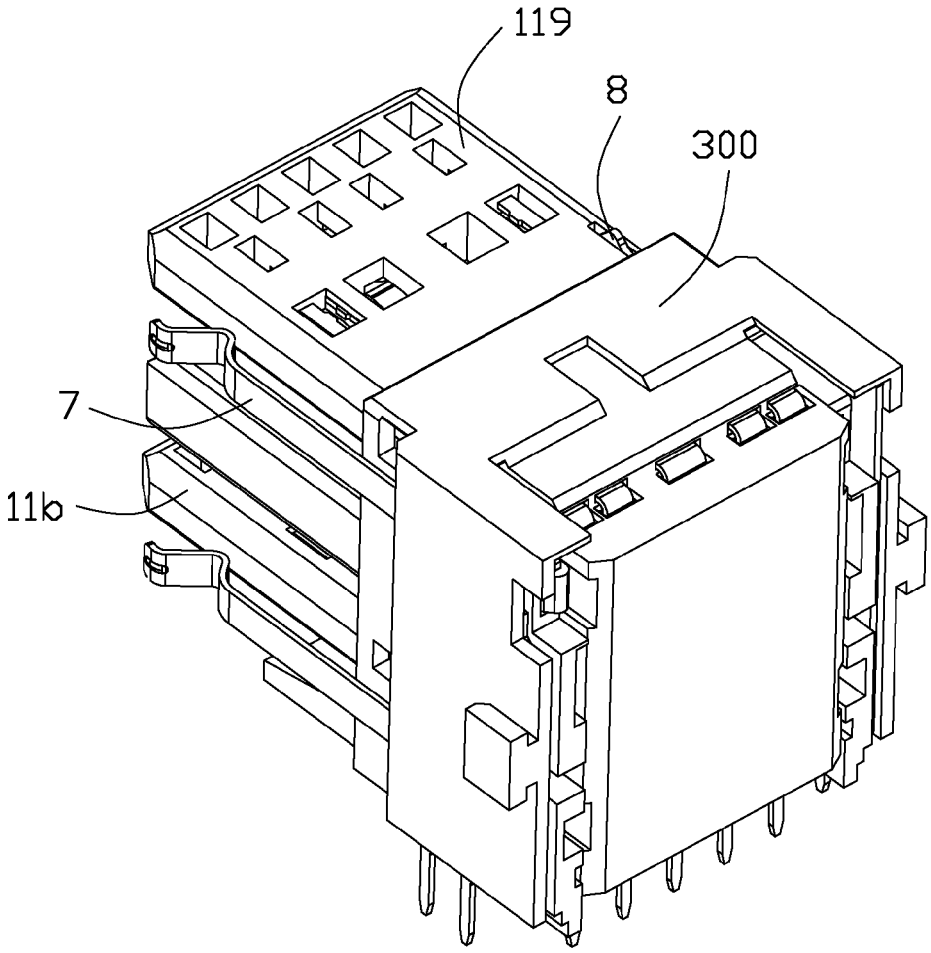
FIG. 14 is an assembled, perspective view of an electrical connector of a third embodiment in accordance with the present invention.
Figure 15:
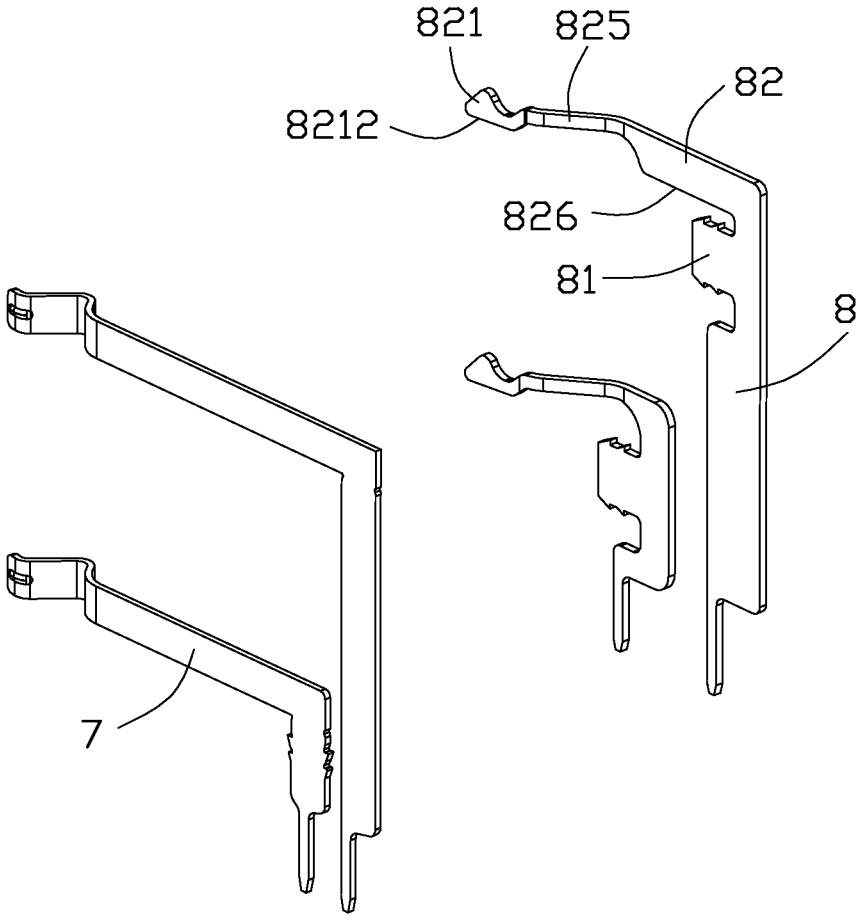
FIG. 15 is a perspective view of first and second detecting pins of the electrical connector shown in FIG. 14.

FIGS. 14 through 15 show an electrical connector 300 of a stacked type USB 3.0 receptacle, of a third embodiment of this present invention. Two parallel and spaced mating tongues 11*a*, 11*b* are provided. Each tongue is disposed with a first detecting pin 7 at a lateral side thereof and a second detecting pin 8 at a top face of the mating tongue. The contacting arms 82 extend from the rear base and the front mating tongue. A retained portion 81 of the upper second detecting pin with bars forward extends near a rear root of the contacting arm 82, for being fitly retained in the base. The bottom side 8212 of the contacting portion is lower than the inclined-inward arm 825 and higher than a bottom edge 826 of a rear portion of the contacting arm 82. The bottom edge 826 abuts against an inside bottom of the second slot, the inclined-inward arm provide an enough elastic force. The bottom side 8212 of the contacting portion 821 is horizontal to ensure a reliable engagement with the extending portion of the plug connector. Said features are also configured in the first and second embodiment.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing formed with a rear base and a front mating tongue, the mating tongue defines a first face, a second face opposite to the first face and two lateral sides between the first and second faces;

a metallic shell covering the insulative housing thereby defining a mating cavity surrounding the front mating tongue for receiving a mating plug and defining an insertion direction;

a plurality of contacts loaded on the insulative housing and comprising contacting portions located on the first face of the mating tongue; and a first detecting pin and a second detecting pin fastened to the rear base, respectively, each of the first and the second detecting pins forwardly protruding and having a contacting portion located in the mating cavity, said the contacting portion of the first detecting pin being located behind the contacting pin of the second detecting pin in the insertion direction;

wherein the contacting portion of the first detecting pin is located along and spaced from one of the lateral sides of the mating tongue, the contacting portion of the second detecting pin is located in the second face of the mating tongue, wherein the contacting portion has a triangular shape with a tip forming a contact point and a bottom side of the triangular shape being parallel to the second face of the mating tongue and spaced from the base.

2. The electrical connector as described in claim 1, wherein the second detecting pin is made from a metal blank sheet, the contacting portion of the second detecting pin has a contacting point at a cutting edge of the metal blank sheet along a thickness direction of the metal blank sheet.

3. The electrical connector as described in claim 2, wherein the second detecting pin comprises a retained portion retained in the base, a leg portion and a contacting arm, the contacting arm directly connects with the retained portion and the contacting portion, the contacting arm has a front inward-inclined arm shifts inwards.

4. The electrical connector as described in claim 3, wherein the base of the insulating housing defines a second slot running through a rear face of the base and opening to the second face of the mating tongue, the second slot defines a wider portion on the base and a smaller portion on the base and the mating tongue, the smaller portion communicates with the wider portion, the front inward-inclined arm is received in the smaller portion and a rear portion behind the front inward-inclined arm of the contacting arm is received in the wider portion of the second slot.

5. The electrical connector as described in claim 4, wherein the wider portion and the smaller portion have same inner sides thereby guiding insertion of the contacting arm of the second detecting pin.

6. The electrical connector as described in claim 1, wherein the base is defined with a flange, the flange defines a first slot through a front face of the base, the second detecting pin comprises a retained portion and a contacting arm extending from the base, the retained portion is retained in the first slot.

7. The electrical connector as described in claim 6, wherein the first detecting pin is made from a blank metal sheet, the contacting portion projects towards the lateral side of the mating tongue perpendicular to a thickness direction of the blank metal sheet of the first detecting pin.

8. An electrical connector comprising:

an insulative housing defining an inserted direction and comprising a rear base and a front mating tongue, the mating tongue defining a first face and a lateral side perpendicular to the first face, the insulative housing defining a slot extending from the base and the mating tongue;

a plurality of signal terminals received in the insulative housing and comprising contacting portions exposed to the mating tongue; and a first detecting pin comprising a retained portion retained to the base and a vertical contacting arm forwardly extending along the lateral side the mating tongue, the vertical contacting arm is driven to shift in a lateral direction perpendicular to the inserted direction;

a second detecting pin comprising a retained portion retained in the base and a vertical contacting arm forwardly extending in the slot, the contacting arm defining a contacting portion in mating tongue;

wherein the contacting portion of the second detecting pin is driven to shift in a direction perpendicular to the lateral direction and the inserted direction.

9. The electrical connector as described in claim 8, wherein the contacting portion of the second detecting pin is in a planar triangle shape.

10. The electrical connector as described in claim 9, wherein a bottom side of the planar triangle shape is lower than that of a front portion of the contacting arm and higher than that of a rear portion of the contacting arm.

11. An electrical connector assembly used with a plug connector or an electronic card, comprising:

a receptacle connector defining an insulative housing including a rear base and a front mating tongue, said mating tongue defining two opposite primary surfaces in a first direction and two opposite lateral side surfaces in a second direction perpendicular to said first direction;

a plurality of contacts disposed in the housing with contacting portions exposed upon at least one of said primary surfaces and with tail portions exposed behind the housing for mounting to a printed circuit board;

a metallic shell enclosing the housing and cooperating with the housing to define a mating cavity;

a first detect pin disposed beside the mating tongue with a first contacting section extending into the mating cavity and between the mating tongue and the metallic shell, and a first tail section exposed outside of the housing for mounting to the printed circuit board; and a second detect pin disposed in the housing with a second contacting section extending beyond the other of said two opposite primary surfaces, and a second tail section exposed outside of the housing for mounting to the printed circuit board, the first contacting section being located in front of the second contacting section in a third direction perpendicular to both said first direction and said second direction; wherein the first contacting section is outwardly deflected to mechanically and electrically connect to the metallic shell when either the plug connector or the electronic card is inserted into the mating cavity for activation; the second contacting section is inwardly deflected by and directly mechanically and electrically connected with a metallic shield of the plug connector which is a power delivery connector with a lengthened dimension thereof while being unable to be mechanically actuated by either electronic card or the plug connector with a standard length thereof.

12. The electrical connector assembly as claimed in claim 11, wherein first detect pin is located beside said mating tongue in said second direction.

13. The electrical connector assembly as claim 11, wherein the first tail section is located outside of the second tail section in the second direction.

14. The electrical connector assembly as claimed in claim 11, wherein said metallic shell defines spring tang which abuts against the first contacting section when said first contacting section is outwardly deflected.

* * * * *